United States Patent [19]

Laapotti

[11] Patent Number: 4,586,983

[45] Date of Patent: May 6, 1986

[54] PROCEDURE AND MEANS IN THE TREATMENT BY PRESSING OF A FIBRE WEB, IN PARTICULAR OF A PAPER OR CARDBOARD WEB

[75] Inventor: Jorma Laapotti, Jyväskylä, Finland

[73] Assignee: Valmet Oy, Finland

[21] Appl. No.: 638,683

[22] Filed: Aug. 8, 1984

Related U.S. Application Data

[63] Continuation of Ser. No. 493,948, May 12, 1983, abandoned.

[30] Foreign Application Priority Data

May 13, 1982 [FI] Finland ..... 821687

[51] Int. Cl.[4] ..... D21F 3/02

[52] U.S. Cl. ..... 162/205; 162/358; 162/360

[58] Field of Search ..... 162/205, 358, 360, 361; 100/154, 152, 153

[56] References Cited

FOREIGN PATENT DOCUMENTS 2829226 1/1979 Fed. Rep. of Germany ..... 162/358

*Primary Examiner*—Peter Chin

*Attorney, Agent, or Firm*—Steinberg & Raskin

[57] ABSTRACT

A pressing method and apparatus for dewatering a fibre web, such as a paper or cardboard web, in a paper machine press section including two press rolls through which the web is conducted carried on either a single fabric or interposed between a pair of fabrics. The web is pre-pressed in a pre-pressing zone located in the throat region between the press rolls. The pre-pressing pressure is applied to the web through the mediation of a substantially impermeable band which passes through the press nip in overlying relationship with the web as the latter is conducted over a sector of one of the press rolls. After the pre-pressing step, the web is immediately conducted through the zone of the press nip, the pressing of the web which takes place in the press nip determining the dry matter content of the web subsequent thereto. The pre-pressing zone immediately precedes the zone of the press nip so that the pre-pressing and nip zones together in combination constitute a pressing zone. The peak pressing pressure present in the press nip zone is greater than the pressure in the preceding pre-pressing zone.

18 Claims, 7 Drawing Figures

PROCEDURE AND MEANS IN THE TREATMENT BY PRESSING OF A FIBRE WEB, IN PARTICULAR OF A PAPER OR CARDBOARD WEB

This is a continuation, of application Ser. No. 493,948, filed 5/12/83, now abandoned.

BACKGROUND OF THE INVENTION

The present invention relates to a pressing method for dewatering a fibre web, such as a paper or cardboard web, in a paper machine press section including a press nip defined by two press rolls and wherein the web to be dewatered is conducted through the press nip either being carried by a single fabric or interposed between two fabrics.

The invention further relates to an apparatus for carrying out the method of the invention, the apparatus comprising two press rolls defining a press nip, one of the press rolls preferably being a smooth-surfaced roll while the other preferably being a recessed-surface roll, and wherein one or more press fabrics are conducted through the nip.

The most common method of dewatering fibre webs and, in particular, paper or cardboard webs, comprises conducting the web through a press nip defined by two rolls in opposed relationship with each other. Preferably, one or two press fabrics are conducted through the dewatering press nip in order to carry away the water pressed from the web and to also function to transport the web from the press nip.

As the production rates of paper machines increase, the dewatering of the web in the press section has become a major limiting factor with regard to production rates due to the fact that the press nips defined by a pair of rolls have a relatively short region of action and, therefore, the time spent by the web in such press nips is relatively short at higher web speeds. A certain minimum time, however, is required in view of the flow resistance presented by the fibre structure of the web for the water to escape from the web and enter into the recessed surface of the press roll or rolls or the press fabric. For this reason, a plurality of successive press nips have been utilized in the past. For example, so-called compact press sections, such as the so-called "Sym-Press" press section manufactured by Valmet Oy of Finland, or several separate successive press nips have been used in conventional press sections. However, press sections incorporating several nip presses have large space requirements, especially where separate successive press nips are used. A compact press section of the type mentioned above presents difficulties with respect to the optimal placement of their various components as well as in their operation, e.g., with respect to carrying off paper broke. Moreover, expensive suction rolls are commonly employed in nip presses, such suction rolls having significant energy requirements for producing the vacuum and since a perforated shell is a necessity for such suction rolls, problems of mechanical strength also arise in connection with their use.

Further, a web can only tolerate a certain maximum nip pressure so that increases in dewatering through corresponding increases in nip pressures are limited by the pressures which can be tolerated by the web.

Attempts to lengthen the pressing zone of the press nips through the use of larger diameter rolls and/or soft press fabrics are also limited for economic reasons, among others.

However, in view of the various dewatering considerations discussed above, and for other reasons, so-called long nip presses have recently been designed. For example, such long nip presses are disclosed in U.S. Pat. Nos. 3,808,092; 3,808,096; 3,840,429; 3,970,515; 4,201,624 and 4,229,253, and British patent application No. 2057027.

Further regarding the state of the art, reference is made to Finnish patent application No. 3554/72 and U.S. Pat. No. 3,783,097. A paper machine press arrangement is disclosed in said Finnish patent application for dewatering a paper web wherein a long pressing zone is provided by means of appropriately tensioning flexible belts. This arrangement, however, has the drawback that the mechanical strength of the press belts and their associated guide rolls impose a limit on the pressure which can be exerted on the web and, therefore, on the web dewatering which can be accomplished. A long nip press is disclosed in the above-mentioned U.S. patent wherein a plurality of successive pressure shoes are urged towards a belt and opposing press roll. However, this arrangement has the drawback that the friction between the pressure shoes and the belt results in the consumption of large amounts of energy. Additionally, the belt and pressure shoes are subject to considerable attrition as a result of friction between them.

A press section incorporating a long nip press is disclosed in the above-cited U.S. Pat. No. 3,840,429 wherein the web being pressed runs while interposed betwcen two felts rectilinearly through the press zone defined by two opposed press shoes. Pressure is produced in the press zone by means of a pressurized fluid. Bands are provided within the loops of the felts which confine the press zones and transmit the pressure of the pressurized fluid to the web. However, this long nip press is not entirely satisfactory since sealing problems are encountered in the press zone. Another drawback of this arrangement is that the web is immediately subjected to the entire, and necessarily relatively high, pressure in the nip. However, since the web has a relatively low dry matter content, it cannot tolerate pressures exceeding a certain maximum without breaking For this reason, the nip pressure must be maintained at a relatively low level. Moreover, it is generally not advisable to subject a web to a high nip pressure which rises abruptly at the very initiation of the pressing operation.

SUMMARY OF THE INVENTION

Accordingly, it is an object of the present invention to provide new and improved pressing methods and apparatus for dewatering a fibre web, such as a paper or cardboard web, in a paper machine press section.

It is a main object of the present invention to provide a new and improved method and apparatus by which the drawbacks of conventional pressing methods and apparatus are substantially eliminated.

Still another object of the present invention is to provide a method for pressing a fibre web which is novel and in many respects superior in operation to those of the prior art and a long nip press apparatus for applying the method.

Briefly, in accordance with the method of the present invention, these and other objects are attained by subjecting the web being treated to a pre-pressing step in a pre-pressing zone arranged in the throat region between nip-defining rolls. The pressure in the pre-pressing zone is supplied by means of a pressurized fluid, the pressure being applied against the web through the mediation of an impermeable band while the web is situated on a sector of one of the rolls. Subsequent to the pre-pressing step, the web is immediately conducted through the zone of the press nip, the pressing of the web which takes place within the press nip zone being adjusted to primarily determine the dry matter content of the web after the press.

According to the apparatus of the present invention, a long nip press is formed in a paper machine press section by providing a pressure shoe in the throat region between the press nip defining rolls on the incoming web side thereof. In one embodiment, the pressure shoe is provided with sealing members which form at least one pre-pressing chamber adapted to be supplied with fluid under pressure. In another embodiment, the pressure shoe is operatively associated with a press shoe which is actuated by a pressurized fluid chamber provided in the pressure shoe. The pressurized fluid of the pre-pressing chamber in the first embodiment or the press shoe in the second embodiment acts through the mediation of an impermeable band which passes through the press nip on the web which is conducted over a sector of one of the press rolls to apply a pre-pressing pressure onto the web prior to the latter passing into the press nip.

The method and apparatus of the invention result in a relatively long pressing distance and time for the web. It is thus possible to achieve a relatively high dry matter content in the web being treated. In some cases, it is possible to replace the entire multiple-nip press section of a paper or cardboard machine with a press arrangement having a lengthened pressing zone in accordance with the invention. Consequently, significant economy is also achieved through the reduction of space requirements.

Since the web is pressed in a press nip defined by a pair of rolls in the ultimate part of the pressing zone in accordance with the invention, the pressure in the roll pressing zone can be adjusted to be quite high without incurring any risk of destroying the web structure since the dry matter content of the web reached in the pre-pressing zone is relatively large so that the web can therefore tolerate a relatively high-pressure ultimate pressing step during the pressing operation. In this manner, it is possible to achieve very high dry matter content for the web.

Another advantage obtained by the invention is that the sealing at the ultimate or downstream end of the pre-pressing chamber is improved relative to conventional arrangements since such ultimate end of the pre-pressing chamber borders on the roll press nip. Thus, in presses which operate only with a pressure surface, the difficulties inherent in the sealing of the press chambers impose a limit on the pressure which can be exerted on the web and thereby also limit the dry matter content of the web which can be obtained in the press.

In the press of the invention, the pressures applied to the web in the pre-pressing and nip pressing steps can be controlled over relatively wide ranges so that an optimum pressure profile can be obtained in the press section.

Since the last press step in accordance with the method and apparatus of the invention takes place in a nip defined between press rolls and such rolls can be adapted to be deflection-controlled or compensated, it is possible to thereby control the transverse moisture profile of the web. The transverse moisture profile of the web can also be adjusted by dividing the pre-pressing chamber in the transverse direction into several partial chambers which are filled with a pressurized fluid, the pressure of which can be separately controlled. However, since a relatively high end pressure can be applied, the presence of a high tension stress on the impermeable band which confines the pre-pressing chamber on the web side, and which is usually present in sliding surface presses of the prior art, can be avoided.

DESCRIPTION OF THE DRAWINGS

A more complete appreciation of the present invention and many of the attendant advantages thereof will be readily understood by reference to the following detailed description when considered in connection with the accompanying drawings, to the details of which the invention is not to be confined, in which.

DESCRIPTION OF THE PREFERRED EMBODIMENTS

Figure 1:
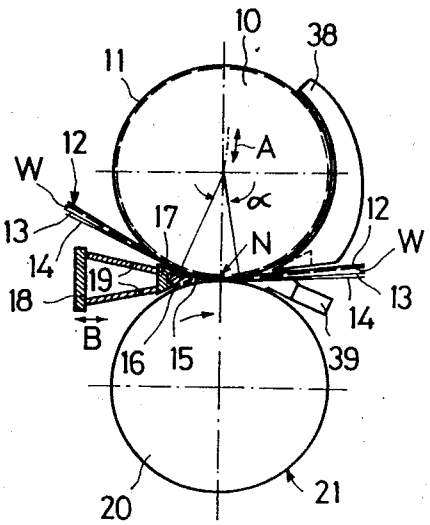
FIG. 1 is a schematic side elevation view in partial section of a press according to the present invention.

Referring now to the drawings wherein like reference characters designate identical or corresponding parts throughout the several views, and more particularly to FIG. 1, a press in accordance with the invention provides an elongated press zone $\alpha$ defined by an upper press roll 10 provided with a recessed surface 11, a lower press roll 20 having a smooth surface 21 and a pressure shoe 16. The pressure shoe 16 is mounted on a beam by means of a dovetail arrangement 17' (FIG. 2), the beam being composed of walls 17, 18 and 19. The beam may be deflection-compensated and associated with means for moving the same in the directions of arrow B into and out of the throat region between the rolls 10 and 20. The rolls 10 and 20 define a press nip N at the trailing end of the press zone , it being understood that the region of the press nip N forms a part of the press zone $\alpha$.

Passing through the press zone $\alpha$ and the press nip N thereof are, starting from the surface of roll 10, a press fabric 12, the web W being carried into the press on the outer side of the fabric 12, a second press fabric 13 on the side of the web W opposite to that engaging the press fabric 12, the web W running through the press zone $\alpha$ interposed between the press fabrics 12 and 13. Thus, the press fabrics 12 and 13 which may, for example, be constituted by press felts, serve to transport the web W forward through the press zone and at the same time contribute to carrying the water which escapes from the web W in the press zone $\alpha$ out from the press zone. Felt conditioning means (not shown) are provided in the loops of the press fabrics 12 and 13 for cleaning and drying the press fabrics. Water collecting means 38 are situated in conjunction with the upper roll 10 after the nip N so that water accumulating in the recessed surface 11 of roll 10 is flung into the water collecting means 38.

In addition to the fabrics 12 and 13 between which the web W passes through the press zone $\alpha$, a flexible band 14 formed of an impermeable material, such as stainless steel, rubber or plastic having suitable reinforcement, passes through the press zone in overlying relationship to the web and carrying fabrics.

Figure 2:
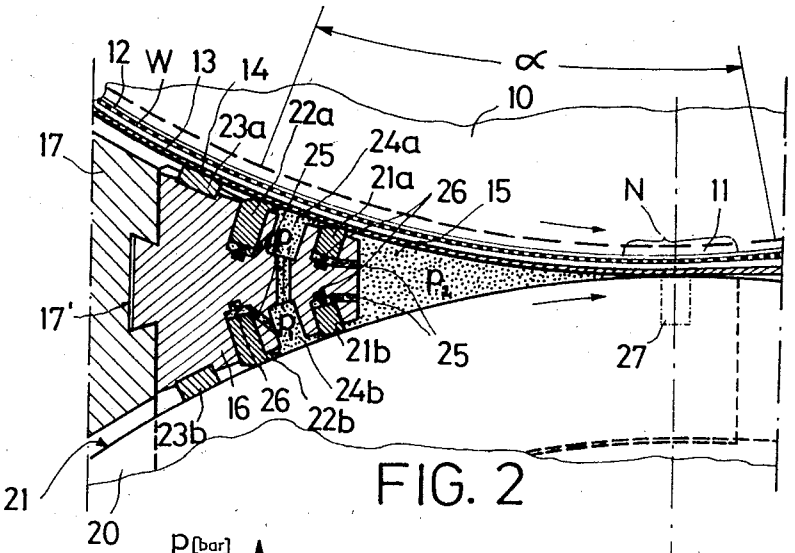
FIG. 2 is a schematic elevation view of the press illustrated in FIG. 1 on an enlarged scale.

Referring to FIG. 2, the paper or cardboard web W is pressed between the felts 12 and 13 so that the highest pressure acting on the web is produced in the nip N between the rolls 10 and 20. This nip N is preceded by a pre-pressing zone wherein a lower pressure acts on the web but over a wider extent. The pre-pressing zone comprises a pressure chamber 15 and preceding pressure chambers 24*a* and 24*b* disposed in parallel relationship with each other. Referring to the graph of FIG. 3, the pressure acting in the press nip zone N is designated $p_N$, the pressure acting in the pressure chamber 15 is designated $p_2$ and the pressure acting in the pressure chambers 24*a* and 24*b* is designated $p_1$. The pressures $p_2$ and $p_1$ of the pressurized fluids in the pressure chambers 15 and 24*a* are transmitted to the web W by the impermeable band 14 and the felt 13 in the prepressing zone. The pressurized volume of the pressure chamber 15 is confined on the side of the web W by the inner surface of the impermeable band 14, on the opposite side by the smooth surface 21 of the lower press roll 20 and by the nip N defined by the roll surface 21 and the inner surface of the band 14. On the side of the chamber opposite to the press nip N, the pressure chamber 15 is confined by the pressure shoe 16 and by lath-like seal members 21*a* and 21*b* situated in respective grooves formed in the pressure shoe 16.

A pair of bores 25 open through the end surface of the pressure shoe 16 facing the pressure chamber 15 and into the bottoms of the grooves in which the seal members 21*a* and 21*b* are situated to transmit the pressure $p_2$ behind the seal members 21*a* and 21*b*. Further, the seal members 21*a* and 21*b* are biased outwardly by means of a series of springs 26.

Figure 3:
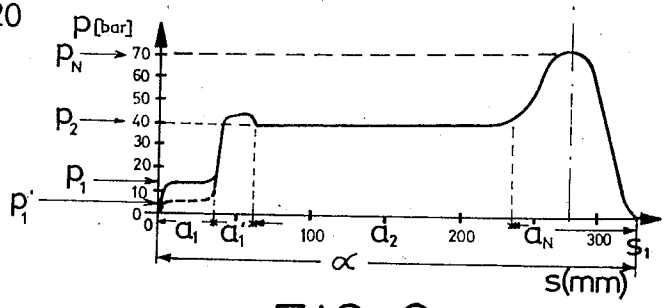
FIG. 3 is a graphical illustration showing the distribution of pressure in the press of FIGS. 1 and 2.

A second set of seal members 22*a* and 22*b* are situated in respective grooves outwardly of the lath-like seal members 21*a* and 21*b*. Bores, also designated 25, transmit the pressure $p_1$ in pressure chambers 24*a* and 24*b* behind the seal members 22*a* and 22*b* and, moreover, springs, also designated 26, urge the seal members 22*a* and 22*b* outwardly. In this manner, second pressure chambers 24*a* and 24*b* are formed between the seals 21*a* and 22*a* and the seals 21*b* and 22*b*, the second pressure chambers 24*a* and 24*b* carrying a pressure $p_1$ which is lower than the pressure $p_2$ of the chamber 15. As noted above, the pressure distribution in the press zone $\alpha$ is illustrated in FIG. 3.

The second pressure chambers 24*a* and 24*b* formed between the seals 21*a* and 22*a* and 21*b* and 22*b* function to step the pressures acting in the press zone $\alpha$ so as to reduce the loads acting on the seals. In this connection, the outer seal members 22*a* and 22*b* are preferably resilient lip seal members which insure good sealing while the inner seal members 21*a* and 21*b* are hard, wear-resistant lath-like members which are appropriately shaped to produce a lubricating film and consequent internal leakage which creates the pressure $p_1$ in the chambers 24*a* and 24*b*. Although this leakage causes a constant requirement for hydraulic or pneumatic energy, it also prevents the pressurized fluid from spreading out from the chambers 15 and 24*a*, 24*b*. Generally, the seal members 21*a*, 21*b* and 22*a*, 22*b* may be loaded by directing the pressurized fluid behind them in the manner described above and/or by means of the springs 26. The seal members are thus loaded against the surface 21 of the roll 20 or against the inner surface of the impermeable band 14.

Figure 6:
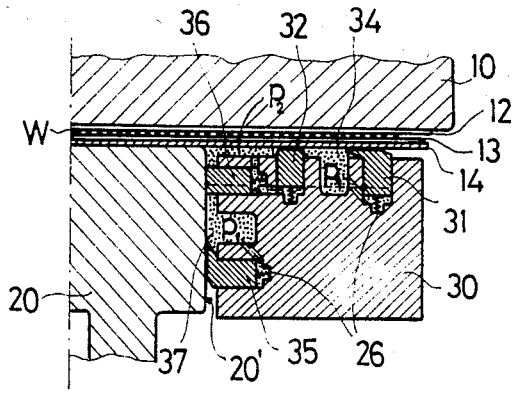
FIG. 6 is a section view taken along a plane parallel to the axes of the press rolls of the press section of FIG. 2.
Figure 7:
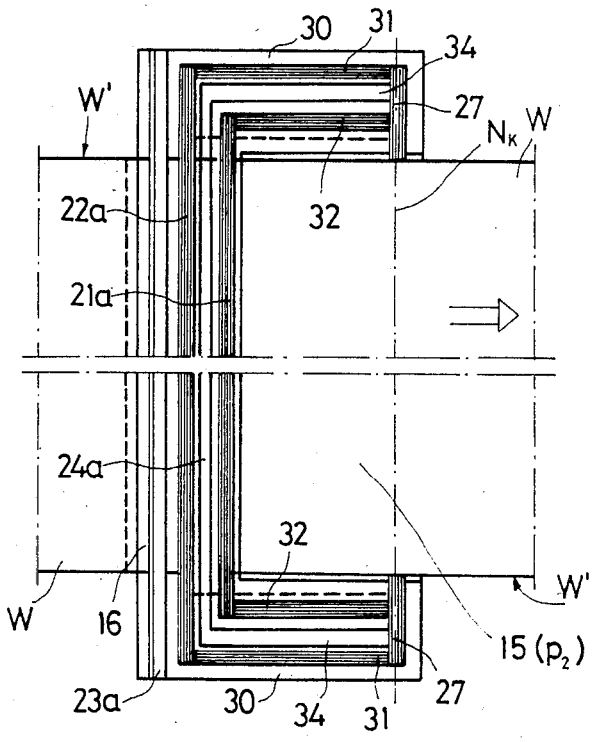
FIG. 7 is a top plan view of the press illustrated in FIG. 2 with the upper roll removed for clarity and showing the sealing arrangement for the various pressure zones.

Referring to FIGS. 6 and 7, the sealing of the pressure chambers illustrated in FIGS. 1 and 2 as well as the sealing of their transverse ends situated outwardly of the margins W' of the web W is illustrated in a top plan view. The pressure shoe 16 as seen in FIG. 6 and 7 is formed with laterally projecting parts 30 in which seals 27, 31, and 32 are mounted for sealing the ends of the pressure chamber 15. The outer lath-like sealing members 22*a* extend in the grooves formed in both end parts 30 in the form of end seals 31. Similarly, the inner seal member 21*a* continues in the form of seals 32 in grooves provided in the end parts 30. The lath-like seal members 31 and 32 join in the end parts 30 to form the lath-like seal members 27 which are located in the plane of the center-line $N_K$ of the nip N. In this manner, the lath-like seal members 27, 31 and 32 define end chambers 34 in conjunction with the end parts 30. The end chambers 34 communicate with the pressure chamber 24*a* so as to carry the same pressure $p_1$ therein. The end parts 30 of the pressure shoe 16 are also sealed against the respective planar end faces 20' of the lower roll 20 as seen in FIG. 6. This sealing is accomplished using a hard lath-like seal member 36 and a softer lip seal member 35, the seal members 35 and 36 defining a chamber 37 between them in which the pressure $p_1$ prevails. In this manner, the step arrangement of the pressures $p_1$ and $p_2$ at the ends of the chamber 15 is preserved.

Referring back to FIG. 3, the pressure p in the chambers 24*a* and 24*b* is about 15 bar. Alternatively, a lower pressure may be provided in these chambers such, for example, as about 5 bar, this state being shown by the dotted lines in FIG. 3. In the region $a_1'$ of the lath-like seal members 21*a* and 21*b*, the pressure rises to the pressure $p_2$ of pressure chamber 15, this pressure being, for example, about 40 bar.

As also seen in FIG. 3, the pressure in the region $a_N$ of the press nip zone N is higher than the pressure $p_2$ in the preceding pressure chamber 15 which carries the pressurized fluid. The maximum pressure $p_N$ present at the center-line $N_K$ of the nip is substantially higher than the pressure $p_2$ in the region of the pressure chamber 15, the pressure $p_N$ being, for example, about 70 bar. Moreover, as seen in FIG. 3, the length of the entire pressure zone is about 320 mm.

Pressurized fluid is supplied into the pressure chamber 15 carrying the pressure $p_2$ by means of appropriate piping from a hydraulic pump or air compressor. A circulating system which is at least partly closed can be arranged for the pressurized fluid whereby the fluid which seeps through the seals is collected such, for example, with the aid of a doctor blade shown in FIG. 1 and a drain 39, the collected fluid being returned to use after being appropriately filtered. The pressure generating and supply means for the pressurized fluid are not shown in the figures since it will be understood by those skilled in the art that their design and operation are conventional.

Any appropriate fluid can be used as the pressurized fluid such, for example, as water, a water/oil emulsion containing about 3% oil, semi-fluid grease, air, or air with added lubricant.

The band 14 through which the pressure is transmitted to the web must be substantially impermeable and have a smooth inner surface. As noted above, the band 14 may comprise a steel band, preferably acid-resistant, or a fabric-reinforced plastic or rubber band. It is noted that the requirement that the surface of the loop of the band 14 be smooth only applies to the inner surface thereof.

The roll 10 comprises a recessed surface roll such, for example, as a grooved or blind-drilled roll. The roll 10 may be constituted by a deflection-controlled or deflection-compensated roll, or by a large diameter cambered roll. The roll 20 may be constituted by a roll having a smooth surface 21, preferably deflection-compensated, or a large diameter cambered roll.

Some of the pressurized fluid will tend to spread onto the surface of the roll 21 and onto the outer surface of the band 14 at the trailing side of the nip N. Such fluid can be removed by means of the doctor blade and drain 39 (FIG. 1) and filtered and reconducted back into use.

The pressure shoe 16 carries a pair of opposed glide laths 23*a* and 23*b* located outwardly of the seal members 22*a* and 22*b*. The glide laths 23*a* and 23*b* function to appropriately position the pressure shoe 16 and determine the proper amount of protrusion of the seal members as the pressure shoe 16 is urged into the throat region. Additionally, the glide laths 23*a* and 23*b* serve as blades for scraping any foreign matter from the band 14 and surface 21 of roll 20.

Clearly, numerous modifications of the illustrated embodiment are possible. For example, the recessed surface roll 10 may be situated below the paper web W with the smooth roll 20 and band 14 positioned over the paper web W. Such an arrangement is advantageous in that the web W can be dewatered to a greater extent in the downward direction and the non-uniform distribution of fines and fillers in the web which may have incurred on the wire section can thus be rectified.

It is also possible within the scope of the invention to situate the pressure chamber on the trailing side of the nip N between the rolls 10 and 20 or, additionally, on both sides of the nip. Such an arrangement, however, is not to be preferred since the highest pressure in the press zone will substantially determine the dry matter content of the web W so that the highest pressure region should be proximate to the ultimate end of the pressing zone $\alpha$, a situation which is obtained by the illustrated preferred embodiment.

Figure 4:
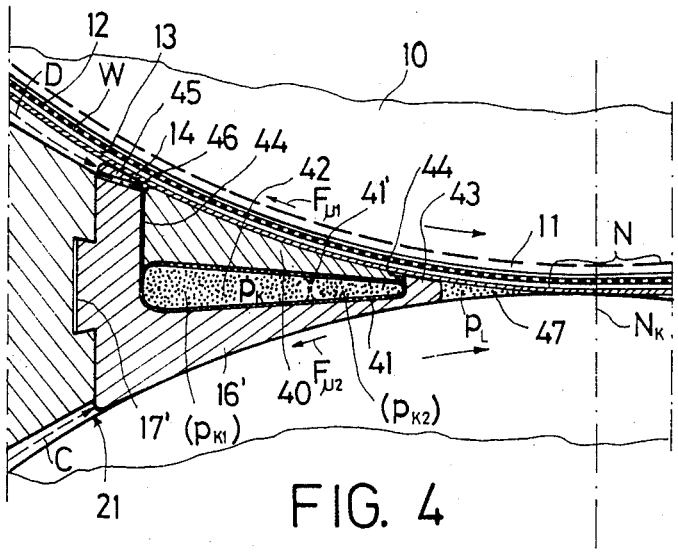
FIG. 4 is a view similar to FIG. 2 illustrating another embodiment of a press according to the invention wherein a press shoe is used in the pre-pressing zone.
Figure 5:
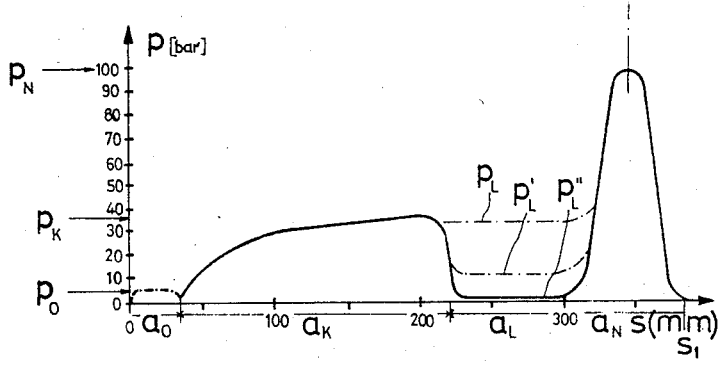
FIG. 5 is a graphical illustration showing the distribution of pressures in the press of FIG. 4.

Referring now to the embodiment illustrated in FIGS. 4 and 5, like the embodiment of FIGS. 1 and 2, a first pre-pressing step is applied to the web followed by an ultimate, higher pressure pressing being applied to the web in the nip N between the rolls 10 and 20. However, the pre-pressing of the web is accomplished in the embodiment of FIGS. 4 and 5 by means of a hydrodynamic shoe 16' which is formed with guiding surfaces 44 between which is situated a press shoe 40 having a curved, smooth outer surface adapted to press against the impermeable band 14 and through the band 14 on the web W. The inner surface of the press shoe 40 borders on a pressure chamber 42 enclosed by a flexible expandable pressurized bellows member 41, the pressure in chamber 42 being designated $p_K$. Alternatively, two or more successive and/or parallel pressure chambers may be provided by a partition shown in dotted lines as 41' in which pressures $p_{K1}$ and $p_{K2}$ exists. By controlling the pressures $p_{K1}$ and $p_{K2}$ and possibly by providing a suitable control of the pressures of the chambers adjacent to each other in a direction transverse to the web W, the distribution of the pre-pressing pressure can be controlled in the press zone $\alpha$ both in the direction of travel of the web W as well as in the direction transverse thereto. In this manner the transverse moisture profile of the web can be influenced as it can be through the deflection control of the rolls 10 and/or 20 as described above. Since the dimension of the pressure shoe 16' in the throat between the rolls 10 and 20 on the incoming web side of the press nip are limited, the counter-force resulting from the pressing force must be taken up on the surface 21 of the lower rolls 20. Since the shoe 16', like the shoe 16 in the embodiment of FIGS. 1 and 2, tends to move away from the nip N, it must be secured to the support beam 17, 18 and 19 as in the case of shoe 16.

Shoe components 43 and 45 are situated on respective sides of the moving press shoe 40 which press against the surface of the band 14. Passages 46 are formed through the components 43 and 45 through which lubricating pressurized fluid flows in the direction of arrow D towards the pressing zone. The lubricating fluid of the hydrodynamic bearing surfaces will collect in front of the nip N between the rolls 10 and 20 and will exert a certain pressure $p_L$, $p_L'$ and $p_L''$ (FIG. 5) in the space 47. If this space 47 is fitted with end seals similar to the type shown in FIGS. 6 and 7, this pressure may, if desired, be elevated to be as high as the pressure $p_K$ which exists in the region of the shoe 40. The arrow C in FIG. 4 indicates the introduction of lubricant in the rubbing region between the curved surface of the shoe 16' and the surface of the lower press roll 20.

The friction forces $F_{\mu 1}$ and $F_{\mu 2}$ acting in the directions of the arrows shown in FIG. 4 may be considered to constitute a drawback of the arrangement of FIG. 4. However, as seen from FIG. 5, since an ascending pressure in the pre-pressing zone is preferred, the friction forces in the pre-pressing zone wherein a low pressure precedes the press nip N will not rise to an objectionable level.

The pressure distribution of the pressing pressure p acting on the impermeable band 14 and on the web W therethrough in the press zone $\alpha$ of the embodiment of FIG. 4 is shown in FIG. 5. A relatively low pressure $p_O$ prevails in the region $a_O$ of the initial part 45 of the shoe 16', the pressure $p_0$ being, for example, about 5 bar. In the next following region $a_K$ of the shoe 40 the pressure gradually rises so that at the downstream end of the shoe 16', the pressure $p_K$ is about 40 bar. The pressure in the region $a_L$ varies depending upon the sealing provided for the component 43 of shoe 16' as discussed above. Such variation is illustrated by the lines designated $p_L$, $p_L'$ and $p_L''$. In the region $a_N$ of the press nip N, the pressure rises to a maximum pressure $p_N$ on the center-line of the press nip N. In the illustrated embodiment, the pressure $p_N$ has a magnitude of about 100 bar. This maximum pressure substantially determines the dry matter content of the web. Subsequent to the center-line $N_K$ of the nip N, the pressure falls abruptly to a negligible pressure. As shown in FIG. 5, the length of the press zone $\alpha$ is about 400 mm.

The diameter of the press rolls 10 and 20 is generally between 1,000 and 2,000 mm, depending upon the width of the paper machine.

Thus, according to the invention, a long pressing zone is obtained which provides a relatively long pressing time so that a high dry matter content of the web W is obtained. It is therefore possible in some cases to entirely replace a multi-nip roll press with a single long nip press according to the invention.

According to the invention, the highest pressure in the long press zone is achieved in the press nip N between the rolls 10 and 20. The pressure in the preceding pre-pressing chamber, or in some instances in the following pressing zone, can be limited to a pre-pressing pressure which affords the advantage that the friction effects of the seals and their life are reasonable.

In presses constructed and operated according to the invention, the dry matter content of the web is substantially determined by the ultimate pressure applied to the web during the pressing process and this pressure can be adjusted so as to be quite high through the use of a roll nip. Moreover, the sealing of the preceding pre-pressing chamber is improved due to the high roll nip pressure.

Since the moisture of the web is ultimately determined by the pressure in the press nip, the transverse moisture profile of the web can be controlled in a known manner by means of deflection control or compensation of the nip defining rolls.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a pressing method for dewatering a fibre web in a paper press section including a single press nip defined by only two press rolls, said press nip and two press rolls defining a wedge-shaped throat region, and wherein the web to be dewatered is conducted through the press nip carried by fabric means, the improvement comprising the steps of providing pressure shoe means defining a pre-pressing zone in a limited portion of said wedge-shaped throat region of the press nip wherein the web and the carrying fabric means are situated on a narrow sector of one of the rolls and wherein a substantially impermeable band overlies the web and carrying fabric means;

applying a low substantially constant first fluid pre-pressure by said pressure shoe means onto the impermeable band on a side thereof opposite said carrying fabric means in the pre-pressing zone; and conducting the web into the zone of the press nip immediately after the pre-pressing step and pressing the web with a second nip pressure having a peak pressure considerably higher than the first pre-pressure therein, wherein the pressing of the web in the press nip zone substantially determines the dry matter content of the web after the press nip.

2. The method of claim 1 wherein the pre-pressing zone is constituted by at least two partial chambers defined in said pressure shoe means which are substantially sealed with respect to each other and the space surrounding the same by sealing means, one of the partial chambers being adjacent to the press nip zone, and wherein the pressures in the partial chambers decrease in a stepwise manner from the partial chamber adjacent the press nip zone to the partial chamber situated outwardly therefrom.

3. The method of claim 1 wherein the pressure in the pre-pressing zone is in the range of about 20 to 50 bar and wherein the pressure in the press nip zone is in the range of about 50 to 150 bar.

4. The method of claim 1 wherein the pre-pressing zone immediately precedes the press nip zone such that the pre-pressing and press nip zones together constitute a pressing zone and wherein the length of the pressing zone is in the range of about 200 to 550 mm.

5. In a press section of a paper machine wherein a fibre web is dewatered, the press section including two press rolls defining a press nip and at least one press fabric conducted through said press nip, the improvement comprising:

a band formed of substantially impermeable material passing through said press nip in overlying relationship with the web and the at least one fabric as the web, at least one fabric, and said band are conducted over a sector of one of said press rolls; and pressure shoe means for applying fluid pre-pressure on said band, the at least one fabric, and the web, in a pre-pressing zone defined by said pressure shoe means being situated in a throat region defined by said press rolls on the incoming side of said press nip and prior to the web passing through any press nips in said press section.

6. The combination of claim 5 wherein said pressure shoe means comprise sealing means defining at least one fluid pressure chamber in open communication with said impermeable band, said chamber adapted to communicate with a source of pressurized fluid.

7. In a press section of a paper machine wherein the fibre web is dewatered, the press section including two press rolls defining a press nip and at least one press fabric conducted through the press nip, the web to be dewatered being conducted through the press nip, the improvement comprising:

a band formed of substantially impermeable material passing through the press nip in overlying relationship with the web and the at least one fabric as the web, at least one fabric, and said band are conducted over a sector of one of the press rolls; and pressure shoe means for applying fluid pre-pressure on said band, the at least one fabric, and the web, in a pre-pressing zone defined by said pressure shoe means being situated in a throat region defined by said press rolls on the incoming side of said press nip and prior to the web passing through any press nips in said press section;

said pressure shoe means comprising sealing means defining at least one fluid pressure chamber in open communication with said impermeable band, said chamber adapted to communicate with a source of pressurized fluid, said sealing means comprising first seal means disposed with respect to said pressure shoe means and defining a main pre-pressing chamber adjacent to the press nip, and second seal means disposed with respect to said pressure shoe means outwardly of said first seal means relative to the press nip, said first and second seal means defining between them at least one partial pre-pressing chamber.

8. The combination of claim 7 comprising means for providing a controlled leakage between said main prepressing chamber and said partial pre-pressing chamber such that a substantially lower pressure exists in said partial pre-pressing chamber than the pressure which exists in said main pre-pressing chamber.

9. The combination of claim 7 wherein said first seal means are constituted by lath-like seal members extending transversely with respect to the machine direction and associated end seal members and wherein said second seal means are constituted by lip seal members extending transversely with respect to said machine direction.

10. The combination of claim 9 wherein said lath-like seal members and lip seal members are situated in corresponding grooves formed in said pressure shoe means.

11. The combination of claim 9 wherein said lath-like seal members are formed of a hard material and said lip seal members are formed of a softer material.

12. The combination of claim 5 further including a beam extending transversely with respect to the direction of travel of the web and wherein said pressure shoe means is mounted on said beam.

13. The combination of claim 7 wherein said pressure shoe means have a first side in confronting relationship to said one of said press rolls and a second side in confronting relationship to the other one of said press rolls, and wherein said first and second seal means comprise respective pairs of first and second seal members, respective ones of said pairs of said first and second seal members being at respective ones of said first and second sides thereof such that the first and second members at said first side of said pressure shoe means are in rubbing contact with said impermeable band and the first and second seal member at said second side of said pressure shoe means are in rubbing contact with the surface of said other one of said press rolls.

14. The combination of claim 7, said pressure shoe means further including a pair of slide shoes, one of said slide shoes being in rubbing contact with said impermeable band and the other of said slide shoes being in rubbing contact with the surface of said other one of said press rolls, whereby said slide shoes carry and substantially center said pressure shoe means.

15. In a press section of a paper machine wherein a fibre web is dewatered, the press section including two press rolls defining a press nip and at least one press fabric conducted through the press nip, the web to be dewatered being conducted through the press nip, the improvement comprising:

a band formed of substantially impermeable material passing through the press nip in overlying relationship with the web and at least one press fabric as the web, at least one press fabric, and said band are conducted over a sector of one of the press rolls; and pressure shoe means for applying fluid pre-pressure on said band, the at least one fabric, and the web, in a pre-pressing zone defined by said pressure shoe means being situated in a throat region defined by said press rolls on the incoming side of said press nip and prior to the web passing through any press nips in said press section;

said pressure shoe means comprising a movable section, and pressurized fluid means provided in said pressure shoe means for urging said movable section against said impermeable band to apply a pre-pressing pressure to the web.

16. The combination of claim 15 wherein said pressure shoe means has a transversely extending elongated groove formed therein and wherein said movable section is situated in said groove.

17. The combination of claim 15 wherein said means for urging said movable section against said band comprise at least one expandable pressurized-fluid chamber provided in said pressure shoe means in operative relationship with said movable section.

18. The combination of claim 15 further including means provided on said pressure shoe means in advance of said movable section for applying a first pre-pressing pressure on said impermeable band and means provided on said pressure shoe means following said movable section for defining together with said press nip a wedge-shaped pressure chamber immediately preceding said press nip.

* * * * *